United States Patent [19]

Luchetta et al.

[11] Patent Number: 4,978,331

[45] Date of Patent: Dec. 18, 1990

[54] METHOD AND APPARATUS FOR CLEANING IN PLACE OF A DECANTER CENTRIFUGE

[75] Inventors: Joseph F. Luchetta, Doylestown; Louis C. Eberle, Warminster, both of Pa.

[73] Assignee: Alfa-Laval AB, Stockholm, Sweden

[21] Appl. No.: 377,980

[22] Filed: Jul. 11, 1989

[51] Int. Cl.[5] ..... B04B 15/06; B04B 9/00

[52] U.S. Cl. ..... 494/37; 210/380.3; 494/27; 494/53; 494/84

[58] Field of Search ..... 494/7, 8, 37, 52, 1, 494/9, 27, 28, 29, 53, 54, 55, 84; 210/106, 768, 772, 380.1, 380.3; 366/95

[56] References Cited

U.S. PATENT DOCUMENTS

| | | | |
|---|---|---|---|
| 548,717 | 10/1895 | Metzger . | |
| 560,632 | 5/1896 | Peck . | |
| 560,634 | 5/1896 | Peck . | |
| 560,635 | 5/1896 | Peck . | |
| 1,230,560 | 6/1917 | Camp . | |
| 1,423,583 | 7/1922 | Steps | 210/772 |
| 2,152,562 | 3/1939 | Olcott | 210/772 |
| 2,443,593 | 6/1948 | Birsch | 494/84 |
| 2,453,791 | 11/1948 | Harstick | 192/58 |
| 2,476,377 | 7/1949 | Le Clair | 494/84 |
| 2,603,413 | 7/1952 | Orelind | 494/27 |
| 2,629,547 | 2/1953 | Orelind | 494/27 |
| 2,649,816 | 8/1953 | Kuster et al. | 494/53 |
| 2,655,241 | 10/1953 | Hultberg | 192/136 |
| 2,919,848 | 1/1960 | Howe | 233/7 |
| 3,494,542 | 2/1970 | Craig et al. | 494/7 |
| 3,734,399 | 5/1973 | Oas | 494/8 |
| 3,741,466 | 6/1973 | Weiland | 494/7 |
| 3,802,621 | 4/1974 | Merzenich | 494/29 |
| 4,036,426 | 7/1977 | Little | 233/7 |
| 4,069,966 | 1/1978 | Crosby et al. | 233/1 |
| 4,073,431 | 2/1978 | Jäger | 233/7 |
| 4,113,171 | 9/1978 | Cyphelly | 233/7 |
| 4,129,249 | 12/1978 | Todd | 233/7 |
| 4,155,503 | 5/1979 | Sears | 233/3 |
| 4,223,829 | 9/1980 | Bange | 494/7 |
| 4,240,578 | 12/1980 | Jackson | 494/8 |
| 4,299,353 | 11/1981 | Bruning et al. | 494/8 |
| 4,327,862 | 5/1982 | Jakobs | 233/7 |
| 4,369,915 | 1/1983 | Oberg et al. | 494/9 |
| 4,411,646 | 10/1983 | Cyphelly | 494/84 |
| 4,416,655 | 11/1983 | Bennett | 494/52 |
| 4,421,502 | 12/1983 | Jakobs | 494/7 |
| 4,432,747 | 2/1984 | Posse et al. | 494/8 |
| 4,496,340 | 1/1985 | Redeker et al. | 494/29 |
| 4,581,009 | 4/1986 | Krämer | 494/37 |

FOREIGN PATENT DOCUMENTS

| | | | |
|---|---|---|---|
| 607739 | 11/1960 | Canada | 494/29 |
| 607740 | 11/1960 | Canada | 494/29 |
| 758458 | 5/1967 | Canada | 494/8 |
| 2501513 | 7/1976 | Fed. Rep. of Germany . | |
| 2551788 | 6/1977 | Fed. Rep. of Germany | 494/7 |
| 3017158 | 11/1981 | Fed. Rep. of Germany | 494/7 |
| 651851 | 10/1975 | U.S.S.R. . | |
| 537700 | 12/1976 | U.S.S.R. | 494/84 |
| 554891 | 4/1977 | U.S.S.R. | 494/9 |
| 660719 | 5/1977 | U.S.S.R. . | |
| 1025458 | 3/1982 | U.S.S.R. . | |
| 1076149 | 12/1982 | U.S.S.R. . | |

*Primary Examiner*—Philip R. Coe
*Assistant Examiner*—Charles E. Cooley
*Attorney, Agent, or Firm*—Seidel, Gonda, Lavorgna & Monaco

[57] ABSTRACT

A decanter centrifuge typically includes a bowl which is rotatable about its longitudinal axis and an independently rotatable screw conveyor mounted coaxially therein. A drive motor is provided to rotate the conveyor at a differential speed from that of the bowl, which has a separate drive motor. An engagement element, in the form of an indexing clutch, an over-running clutch or a selectively controllable clutching element, is provided between the conveyor drive motor and the bowl to simultaneously rotate the bowl and the conveyor during a cleaning in place operation of the centrifuge.

14 Claims, 1 Drawing Sheet

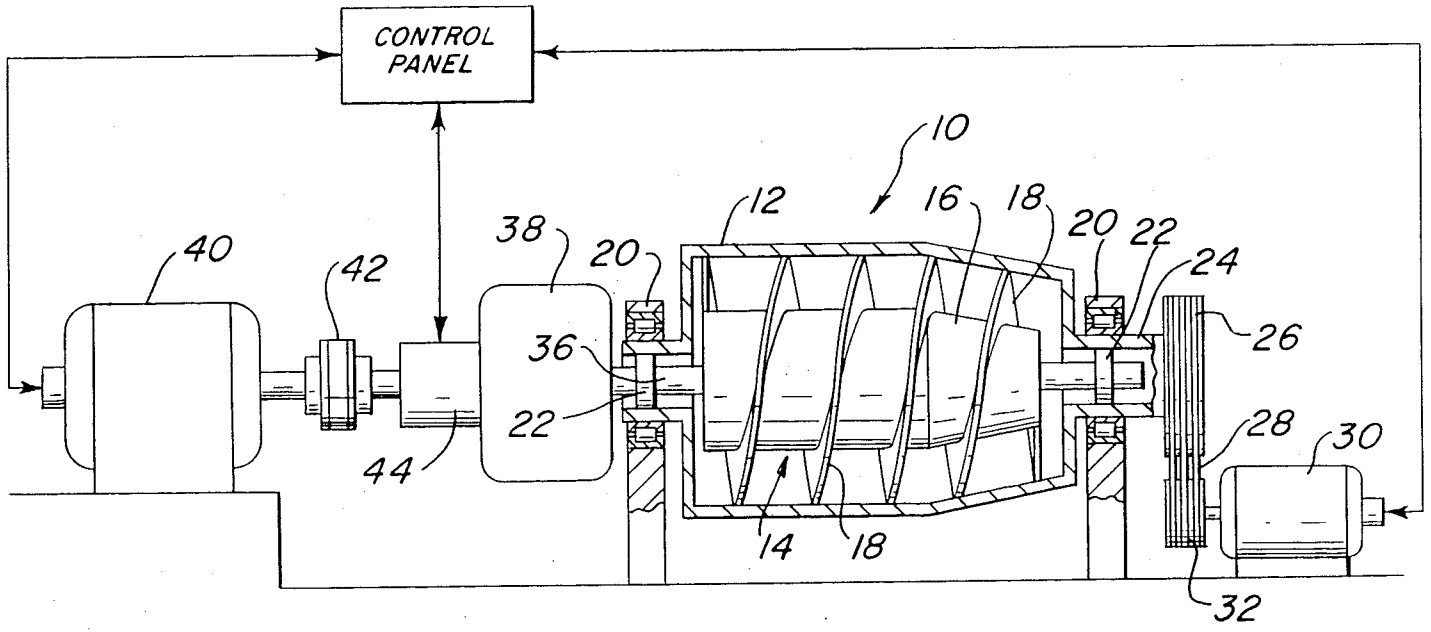
CONTROL PANEL
10
12
14
16
18
18
20
20
22
22
24
26
28
30
32
36
38
40
42
44

METHOD AND APPARATUS FOR CLEANING IN PLACE OF A DECANTER CENTRIFUGE

BRIEF DESCRIPTION OF THE INVENTION

The present invention is a method and apparatus for cleaning centrifuges, and is particularly related to a cleaning in place (CIP) type operation for a decanter type centrifuge.

BACKGROUND OF THE INVENTION

The inside of a bowl of a decanter centrifuge, and centrifuges generally, is required to be cleaned occasionally prior to start up or after use in order to remove the materials which have accumulated along the bowl wall and have not been discharged. Preferably, this clean up is performed without disassembly of the centrifuge.

A decanter type centrifuge generally comprises a rotatable bowl and a screw conveyor mounted coaxially therein. The bowl typically includes a cylindrical section and a tapered end. The screw conveyor is adapted to rotate at a relative speed with respect to the bowl in order to cause discharge of the heavier material separated by the centrifugal forces. Clearance is provided between the inside bowl wall and the periphery of the conveyor flights. The material that settles in this clearance area, called the heel, is not discharged by the conveyor and is compacted onto the inside bowl wall. The heel and the other materials that remain in the bowl after use are commonly required to be cleaned from the bowl at various times in order to prolong the operational life of the centrifuge. Centrifuges of this general type may be cleaned by the method disclosed in U.S. Pat. No. 4,036,426 to T. H. Little. This Little patent is incorporated herein by reference.

Typically a centrifuge requires specifically designed starters and motors to accelerate the bowl to full speed at start up. These special motors commonly require a larger than standard frame size and have long rotors in order to dissipate the excessive heat generated during acceleration. The motor temperature rise and the starter capabilities are the primary limiting factors in the time it takes to accelerate a centrifuge at start up. These factors may add significant size and cost to the motor used for rotating the bowl during normal operation.

U.S. Pat. No. 4,327,862 to W. Jakobs shows a decanter centrifuge having a first and second drive motor for rotating the bowl and the conveyor portions, respectively. The conveyor is driven by the second motor through a planetary gear box. The housing of the planetary gear box is connected to the centrifuge bowl such that during normal operation the conveyor and the bowl are operated at a differential RPM by the two motors. A switchable coupling is provided to connect the input of the planetary gear box to its housing during start up and then to selectively disengage the housing from the input of the planetary gear box after operating speed is attained. The second drive motor is used to drive the bowl and the conveyor during start up. The first drive motor is energized after the bowl has reached operational speed and after the coupling has disengaged the planetary gear box from the housing. The first drive motor continues to rotate the bowl during normal operation while the second motor controls the relative speed of the conveyor through the gear box.

U.S. Pat. No. 4,073,431 to E. A. Jager, shows a decanter centrifuge having a coupling between the bowl and the conveyor to adjust the differential RPM. The coupling is in the form of a hydraulic motor capable of breaking the speed of the conveyor with respect to the bowl during rotation. The conveyor break may be applied to completely stop the conveyor rotation to flush the bowl of the centrifuge.

U.S. Pat. No. 2,919,848 to A. F. Howe shows a decanter centrifuge having an electromagnetic break to adjust the conveyor differential speed. A clutch is also provided to assist in accelerating the conveyor during initial start up. U.S. Pat. No. 4,129,249 to Todd also shows the use of an electromagnetic control element to adjust the differential speed of the conveyor.

U.S. Pat. No. 4,069,966 to Crosby et al. shows a decanter centrifuge having a friction disk for adjustable damping of the centrifuge drive shaft to suppress chatter.

Russian Pat. No. 1025458 shows a torque limiting coupling connected to the output shaft of the reduction gear box and includes two friction discs intended for damping the torsional vibration of the screw conveyor therein.

U.S. Pat. No. 4,155,503 to Sears shows a nondecanter centrifuge having knives as a discharge means. A break is utilized to fix the knives within the bowl during discharge. This patent is generally representative of a series of patents which show non-decanter type centrifuges having clutch elements therein, including U.S. Pat. Nos. 1,230,560 to Camp; 2,453,791 to Harstick; and 2,655,241 to Hultberg.

U.S. Pat. No. 4,581,009 to Kramer and U.S. Pat. No. 4,113,171 to Cyphelly show hydraulic motors for controlling the differential speed of the conveyor with respect to the bowl of a decanter centrifuge.

SUMMARY OF THE INVENTION

The present invention relates to a method and apparatus of cleaning the interior of a bowl of a decanter centrifuge and for accelerating the bowl the centrifuge to operational speed.

One embodiment of the present invention includes a drive motor for rotating the conveyor of a decanter centrifuge at a differential speed with respect to that of the bowl. Means is provided for engaging the conveyor drive with the bowl to simultaneously rotate the bowl and the conveyor during at least a portion of the centrifuge operation. The engagement means may comprise an over-running or indexing clutch which permits the drive motor to simultaneously rotate the bowl and the conveyor at a speed sufficient to cause scouring of the interior of the bowl. Upon reversing the direction of the conveyor drive motor the clutch disengages from the bowl and drives only the conveyor. Alternatively, the engagement means may include a selectively controllable element which causes engagement between the bowl and the conveyor drive motor. In this embodiment, the simultaneous rotation of the bowl and conveyor may also be performed in a direction reverse of the original rotation.

One method of cleaning the interior of the bowl of a decanter centrifuge contemplated by the present invention includes engaging the conveyor and bowl of the centrifuge to the conveyor drive motor. The conveyor drive motor simultaneously rotates the conveyor and the bowl at a predetermined speed for a predetermined period of time to scour the bowl to remove the heel and the other deposited materials. At the end of a predetermined period of time, the conveyor drive motor is disengaged from the bowl and the conveyor rotation is reversed. The reverse rotation of the conveyor is at a predetermined speed and for a predetermined period of time to further clean the bowl and to discharge the scoured materials. The drive motor may again be coupled to the bowl to rotate the bowl and the conveyor simultaneously in the same direction and, thus, repeating the cycle.

BRIEF DESCRIPTION OF THE DRAWING

For the purpose of illustrating the invention, there is shown in the drawing a form which is presently preferred; it being understood, however, that this invention is not limited to the precise arrangements and instrumentalities shown. FIG. 1 shows a schematic illustration of a solid bowl decanter centrifuge in accordance with the present invention.

DETAILED DESCRIPTION OF THE INVENTION

In the figure, there is shown a decanter centrifuge which is generally referred to by the numeral 10. The decanter centrifuge 10 includes a solid and imperforate bowl 12 having a cylindrical portion and a tapered portion and which is mounted for rotation about its longitudinal axis. Mounted coaxially within the bowl 12 is a screw conveyor 14 having a series of conveyor flights 18 mounted on a hub 16. The conveyor 14 is independently rotatable with respect to the bowl 12.

In the system shown, the bowl 12 is supported at opposite ends by bearings 20. The screw conveyor 14 mounted within the bowl 12 is also supported by a separate set of bearings 22. The bowl 12 is connected by means of shaft 24 to belt drive 26. Belt drive 26 is connected by a series of belts 28 to pulley 32 connected to the drive shaft of bowl drive motor 30. Drive motor 30 causes rotation of the bowl 12 in either a clockwise or counter-clockwise direction, as desired. In the embodiment shown in the figure, during normal operation the bowl 12 and conveyor 14 rotate in the counterclockwise direction when viewed from the end of the bowl opposite of the connection to the drive motor 30.

Bowl drive motor 30 is connected to a control panel 34. Control panel 34 typically indicates the rotational speed of the drive motor 30 and is capable of controlling that speed as well as its on-off operation.

The conveyor 14 is connected by means of shaft 36 to the take-off shaft (not shown) of a planetary gear arrangement within the gear box 38. The bowl 12 is connected to the housing of the gear box 38. The housing generally forms the stationary ring gear of the planetary arrangement. The coupling of the bowl 12 and conveyor 14 to the gear box 38 is generally understood by to those in the art.

Gear box 38 is connected to a conveyor drive motor 40 by means of a flexible coupling 42 and engagement means 44. The conveyor drive motor 40 may be a DC backdrive motor or an AC motor with a hydraulic backdrive connected thereto. It is generally contemplated for purposes of the present invention that the conveyor drive motor 40 is reversible in direction.

In normal operation the bowl drive motor 30 will rotate the bowl at a selected rotational speed to create the centrifugal force that causes separation of the materials fed into the bowl 12. The conveyor drive motor 40 rotates the conveyor 14 at a selected differential speed with respect to the bowl 12. This differential speed is created through the gear box 38. Conveyor drive motor 40 is connected to the control panel 34 so that the differential speed can be illustrated as well as controlled.

Engagement element 44 may be any one of a number of different structures. In one embodiment the engagement element 44 is an indexing clutch which is attached to the housing of the gear box 38 as well as its pinion (not shown). The indexing clutch preferably engages only when the conveyor drive motor 40 is rotating in the normal direction operation of the centrifuge 10. Thus, if the normal operating direction is counterclockwise, the indexing clutch 44 engages the gear box housing, and drives the conveyor 14 and bowl 12 simultaneously in that direction. Upon reversing the direction of motor 40, the indexing clutch disengages from the bowl 12 and the motor 40 rotates only the conveyor 14. A similar operation may be performed by an over-running type clutch as the engagement element 44. The engagement element may take the form of a clutch manufactured by the Formsrag Company, a division of Dana Corp., Model No. F50500 or No. F50700. Of course the dimensions and capabilities of the engagement element 44 will depend in part on the size of the centrifuge and its particular application.

The speed of the CIP operation is generally described in U.S. Pat. No. 4,036,426 referred to above. The centrifugal force developed by the cleaning liquid within the rotating bowl during the first portion of the operation, is preferably equal to or slightly less than the gravitational force imposed on the cleaning liquid within the bowl. In this way, the cleaning liquid will not spin with the bowl in a complete circle but, rather, will peel off and spill into the bottom of the bowl, thereby creating turbulence and a washing action. The recommended speed during cleaning for most industrial centrifuges with a horizontally disposed rotational axis is in the order of 50–100 RPMs. This speed is more precisely dictated by the centrifugal force imposed on the annular layer of cleaning liquid which turns as the bowl turns. The 1g low speed operation causes agitation and a continuous falling wave of cleaning liquid which travels up one side of the bowl wall and then tumbles downwardly, thereby scouring not only the bowl wall but also the conveyor flights and the hub.

After disengagement, the bowl 12 will gradually drop in speed since it is free wheeling. By reversing the direction of the conveyor with respect to the bowl and accelerating the conveyor to a speed such as 1,000 RPMs while the bowl is freewheeling, further turbulence is created within the bowl, and the conveyor, via its high differential speed with respect to the bowl wall, will discharge the material from the discharge ports in the tapered end of the bowl. The cycle may be repeated as many times as is deemed necessary to provide proper cleaning.

Engagement means 44 may also be a clutch whose engagement is externally controlled, such as by means of the control panel 34. This automatic clutch may be electro-mechanical, hydraulic or otherwise, as desired. Centrifuges having this type engagement means 44 are generally contemplated to be advantageous for both the CIP operation as well as for the acceleration of the centrifuge during start up to reduce the size of the bowl drive motor 30. Additionally, the clutch may be engaged when the conveyor drive motor 40 is operating in either direction.

The method of cleaning using the controllable clutch is contemplated to be substantially the same as that described with respect to the indexing clutch embodiment. Initially the clutch is engaged such that the conveyor drive motor 40 rotates the bowl 12 and the conveyor 14 in a counter clockwise direction. Upon rotating at a predetermined speed and for a predetermined period of time, the clutch will be disengaged, either via a program installed in the control panel 34 or manually by the operator. The conveyor drive motor 40 is then stopped and then accelerated in the reverse direction to a preset speed. At this point the bowl 12 is free-wheeling and slows down. The reverse in the direction of rotation of the conveyor 14 causes discharge of the material from the bowl 12 through the discharge ports. After a predetermined period of time, the motor 40 is again brought to a stop. The clutch may then be re-engaged to the housing of gearbox 38 and the conveyor drive motor 40 restarted. Again the bowl 12 is rotated simultaneously with and in the same direction as the conveyor 14. This causes further scouring within the bowl 12 in the opposite direction of the initial portion of the cycle. After a period of time, the clutch is then disengaged and the motor 40 brought to a stop. The reverse procedure may again be repeated until the CIP operation is completed.

The engagement means 44 may also be utilized during the start up of the centrifuge 10. With the clutch engaged, the conveyor drive motor 40 rotates both the conveyor 14 and the bowl 12 in the normal direction of operation. Motor 40 will accelerate the bowl 12 and the conveyor 14 to full speed. The clutch will then be disengaged from the housing of the gear box 38, such that the motor 40 is no longer driving the bowl 12. Bowl drive motor 30 is then started and the rotation of the bowl 12 is continued via the drive belts 28. At the same time the conveyor drive motor 40 will decelerate and will take up the normal operation of controlling the differential speed of the conveyor 14 with respect to the bowl 12. This action will act to scroll out the heavy materials which accumulate adjacent the inside bowl wall.

Stopping the rotation of the bowl 12 and the conveyor 14 may be performed by pressing a stop button on the control panel 34 to de-energize the bowl drive motor 30. This action changes the speed of the conveyor drive motor 40 to obtain a maximum differential and scroll out any residual material left in the bowl prior to turning off the conveyor drive motor 40. An emergency stop may be obtained by depressing the emergency stop button on the control panel 34 to de-energize the bowl drive motor 30 and decelerate the conveyor drive motor 40 (if operating in reverse) before accelerating the conveyor to the bowl speed. The clutch will then be engaged to bring the bowl 12 and conveyor 14 to a stop via conveyor drive motor 40. The drive motor 40 will regenerate to a full stop and deenergize.

The present invention may be embodied in other specific forms without departinq from the spirit or essential attributes thereof and, accordingly, reference should be made to the appended claims, rather than to the foregoing specifications, as indicating the scope of the invention.

We claim:

1. A decanter centrifuge comprising:

a bowl rotatable about its longitudinal axis, means for rotating the bowl about its longitudinal axis, an independently rotatable screw conveyor mounted coaxially within the bowl, means for rotating the conveyor at a differential speed from that of the bowl, means for controlling the differential rotation of the conveyor with respect to the bowl, means for engaging the conveyor rotating means with the bowl to simultaneously rotate the bowl and the conveyor in a first direction during at least one portion of an operation cycle, and means for disengaging the bowl from the conveyor rotating means upon a reverse rotation of the conveyor drive means during a second portion of the operation cycle such that the conveyor rotates opposite of the first direction while the bowl continues to rotate in the first direction.

2. A decanter centrifuge as claimed in claim 1 wherein the engagement means is an over-running type clutch.

3. A decanter centrifuge as claimed in claim 1 wherein the engagement means is an indexing clutch.

4. A decanter centrifuge as claimed in claim 1 wherein the engagement means further disengages the conveyor rotating means from the bowl upon the bowl rotating at a faster rate than the conveyor.

5. A decanter centrifuge as claimed in claim 1 wherein the engagement means selectively engages the conveyor rotating means with the bowl to simultaneously rotate the bowl and the conveyor in the reverse rotation.

6. A method of cleaning in place the interior of a bowl of a decanter centrifuge, comprising the steps of:

filling the bowl of a decanter centrifuge with cleaning liquid;

engaging the conveyor and the bowl of the decanter centrifuge to the conveyor drive motor;

simultaneously rotating the conveyor and the bowl at a predetermined speed for a predetermined period of time to rotate the cleaning fluid within the bowl;

disengaging the drive motor from the bowl; and rotating the conveyor in a direction reverse of the initial direction of rotation at a predetermined speed and for a predetermined period of time to further clean the bowl by the action of the cleaning fluid.

7. The method of claim 6 further comprising the step of disengaging the conveyor drive motor from the bowl by reversing the direction of rotation of the motor.

8. The method as claimed in claim 6 further comprising the step of disengaging the conveyor drive motor from the bowl by rotating the bowl at a greater rate than the conveyor.

9. The method as claimed in claim 6 wherein the conveyor and bowl are simultaneously rotated at a speed to create a centrifugal force which is approximately equal to or less than the gravitational force on the materials within the bowl, whereby the conveyor and the interior of the bowl are cleaned by the scouring action of the materials so rotated.

10. The method as claimed in claim 6 wherein the conveyor and bowl are simultaneously rotated at a speed approximately in the range of 50–100 rotations per minute.

11. The method of claim 6 further comprising the step of engaging the bowl and the drive motor to simultaneously rotate the bowl and the conveyor in the reverse direction.

12. A method of cleaning a centrifuge in place, the centrifuge having a bowl formed about a generally horizontal axis and having a screw conveyor disposed coaxially therein, comprising the steps of:

emptying the bowl of process material;

introducing a cleaning liquid into the bowl;

engaging the conveyor and the bowl to the conveyor drive motor;

simultaneously rotating the conveyor and the bowl and the cleaning liquid therewith for a substantial period of time to impose upon the cleaning liquid by rotation a centrifugal force which is approximately equal to or less than the gravitational force on the cleaning liquid, whereby the screw conveyor and the interior of the bowl are cleaned by the agitating and tumbling action of the cleaning liquid;

disengaging the drive motor from the bowl; and rotating the conveyor in a direction reverse of the initial direction of rotation to remove the material cleaned from the sides of the bowl and the conveyor.

13. The method as claimed in claim 12 wherein the conveyor is rotated at a maximum differential speed from that of the bowl during the emptying of said bowl.

14. The method of claim 12 wherein the cleaning liquid is introduced during rotation of the bowl.

* * * * *